United States Patent [19]

Toyoshima et al.

[11] Patent Number: 5,027,469

[45] Date of Patent: Jul. 2, 1991

[54] VACUUM CLEANER

[75] Inventors: Hisanori Toyoshima; Fumio Jyoraku; Mitsuhisa Kawamata; Yoshitaro Ishii; Jiro Arai, all of Hitachi, Japan

[73] Assignee: Hitachi, Ltd., Tokyo, Japan

[21] Appl. No.: 503,764

[22] Filed: Apr. 3, 1990

[30] Foreign Application Priority Data

Apr. 5, 1989 [JP] Japan ..... 1-84829

[51] Int. Cl.[5] ..... A47L 9/12

[52] U.S. Cl. ..... 15/339; 15/347; 15/412

[58] Field of Search ..... 15/412, 339, 347, 352

[56] References Cited

U.S. PATENT DOCUMENTS

| | | | |
|---|---|---|---|
| 3,524,211 | 8/1970 | Wolf | 15/352 X |
| 3,591,888 | 7/1971 | Takeda | 15/352 X |
| 4,072,483 | 2/1978 | Doyle | 15/347 X |

FOREIGN PATENT DOCUMENTS

| | | | |
|---|---|---|---|
| 1484856 | 5/1967 | France | 15/339 |

*Primary Examiner*—Chris K. Moore

*Attorney, Agent, or Firm*—Antonelli, Terry, Stout & Kraus

[57] ABSTRACT

A vacuum cleaner comprising a fan motor disposed in a main body case thereof and having a motor with a permanent magnet stator or rotor, and a fan arranged to be rotated by the motor. A dust-collecting chamber collects dust suctioned into the main body case due to the rotation of the fan motor, and a dust-collecting filter causes the dust suctioned into the main body case to be caught in the dust-collecting chamber. A magnetic material adhesion preventing device is provided in a passage through which air flows due to rotation of the fan motor, with the magnetic material adhesion preventing device acting to prevent adhesion of fine dust composed of magnetic materials included in the air flow to a portion in the vicinity of the permanent magnet. As a result, adhesion of fine dust between the rotor and stator can be prevented thereby increasing the service life and the reliability of the vacuum cleaner.

12 Claims, 6 Drawing Sheets

VACUUM CLEANER

BACKGROUND OF THE INVENTION Field of the Invention

The present invention relates to a vacuum cleaner having a fan motor with a rotor or stator using a permanent magnet. Prior Art In, for example, in Japanese Patent Laid-Open No. 60-242827, a vacuum cleaner is proposed wherein a brushless motor, formed by securing a magnet to a rotational shaft via a yoke, is positioned in a case for the main body of the vacuum cleaner. Dust absorbed from the surface to be cleaned such as the surface of a floor is accumulated in a dust case by a dust collecting filter and, an exhaust air flow from the fan is caused to pass through the brushless motor so that the rotor and the stator of the brushless motor are cooled.

According to the above-described conventional technology, fine dust which has passed through the dust collecting filter is introduced into the brushless motor. Therefore, the thus introduced fine dust adheres to the magnet of the brushless motor if the fine dust is composed of magnetic materials such as iron dust. It leads to a problem in that the magnet and the stator inevitably become stuck if the space disposed between the magnet serving as the rotor and the stator is filled with the fine dust.

SUMMARY OF THE INVENTION

Accordingly, an object of the invention is to provide a vacuum cleaner in which fine dust composed of magnetic materials such as iron dust cannot be stuck to a permanent magnet even if the permanent magnet is used in the rotor or the stator of a fan motor.

The above-described object can be achieved by a vacuum cleaner comprising a fan motor disposed in a main body case thereof and having a motor arranged in such a manner that a rotor or its stator, uses a permanent magnet, with a fan being by the motor. A dust-collecting chamber collects dust suctioned into the main body case due to the rotation of the fan motor, and a dust-collecting filter cause the dust, suctioned into the main body case to be caught in the dust-collecting chamber. Magnetic material adhesion preventing means are provided in a passage through which air flows due to rotation of the fan motor, with the magnetic material adhesion preventing means acting to prevent adhesion of fine dust composed of magnetic materials included in the air flow to a portion in the vicinity of the permanent magnet.

The magnetic material adhesion preventing means comprises a fine-dust catching filter capable of catching the fine dust composed of magnetic materials which has passed through the dust-collecting filter and/or an insulating wall for hermetically insulating the rotor from an air flow generated due to rotation of the fan motor.

When the fan motor is rotated during a cleaning operation, dust is suctioned from the surface to be cleaned, such as the surface of a floor, into the dustcollecting chamber in the main body case. The dust suctioned into the dust-collecting chamber is caught by the dustcollecting filter in the dust-collecting chamber.

If fine dust composed of magnetic materials is included in the dust suctioned into the main body case, the magnetic materials can pass through the dust-collecting filter. The fine dust which has passed through the dust-collecting filter is caught by the dust filter in a structure according to the present invention in which the fine dust filter is provided. As a result, the fine dust cannot reach the fan motor. On the other hand, in the case according to the present invention in which the insulating wall capable of hermetically insulating the rotor comprising the permanent magnet, the fine dust does not reach the outer surface of the rotor of the fan motor by the action of the insulating wall. Therefore, adhesion of the fine dust to the magnet portion of the fan motor can be prevented.

Other and further objects, features and advantages of the invention will be appear more fully from the following description.

DETAILED DESCRIPTION OF THE PREFERRED EMBODIMENTS

Figure 1:
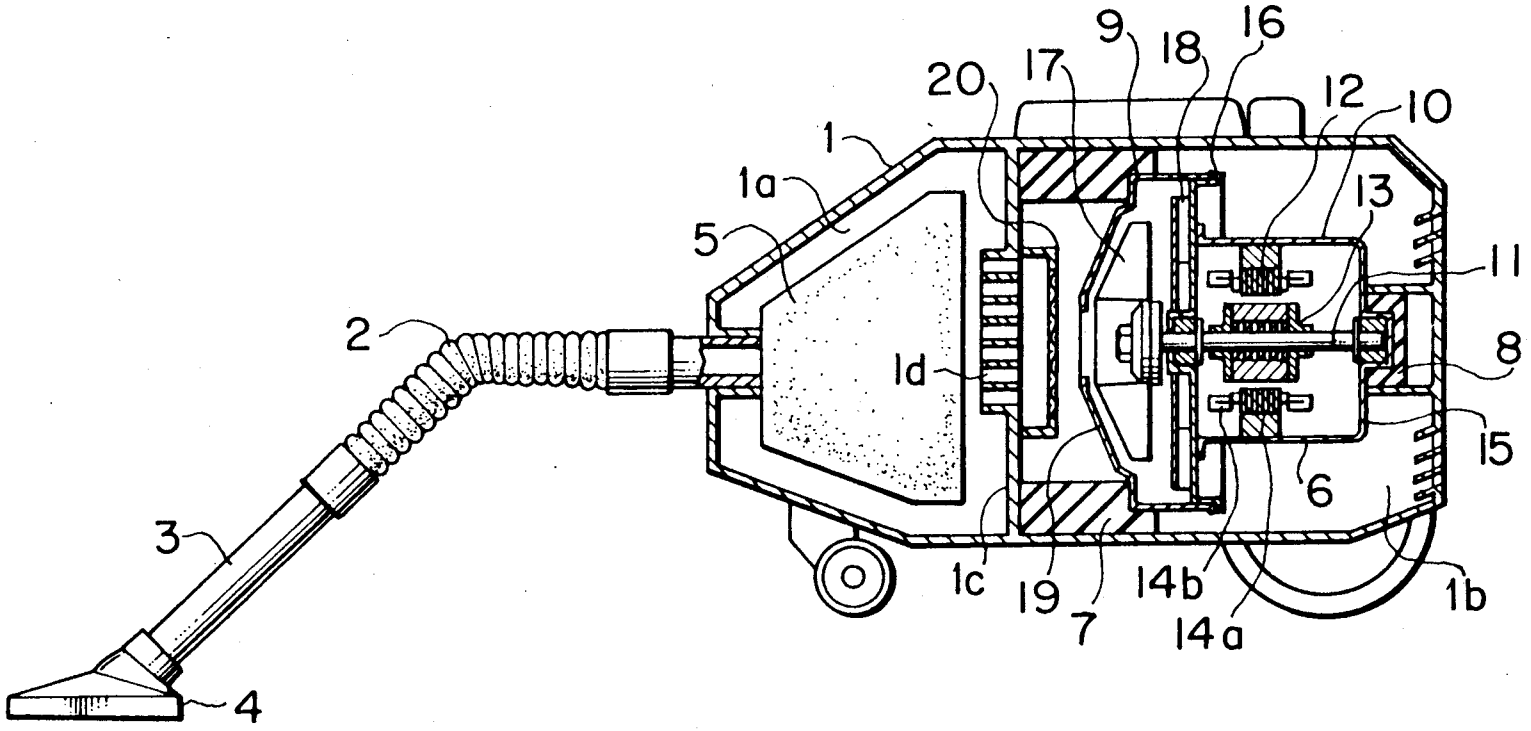
FIG. 1 is a vertical cross sectional view which illustrates a first embodiment of the present invention.

Referring now to the drawings wherein like reference numerals are used throughout the various views to designate like parts and, more particularly, to FIG. 1, according to this figure, a main body case 1 of a vacuum cleaner is sectioned into a dust-collecting chamber 1*a* and a fan-motor accommodating chamber 1*b* by a partition body 1*c*. A grid-shape communicating port 1*d* is formed in the partition body 1*c*. A hose 2 connected to the dust-collecting chamber la is detachably fastened to the front surface of the main body case 1.

A extension pipe 3 is detachably connected to the hose 2. A nozzle 4 is detachably fastened to the extension pipe 3. A dust-collecting filter 5 in the form of paper back or a cloth back container and having a shape maintaining characteristic is placed in the dust-collecting chamber 1*a*. Thus, dust suctioned into the dust-collecting chamber 1*a* is introduced into the dust-collecting filter 5 after the dust has passed through the nozzle 4, the extension pipe 3 and the hose 2. The dust-collecting filter 5 can be withdrawn from the dust-collecting chamber 1*a* after the cleaning operation has been ended.

A fan motor 6 is placed in the fan-motor accommodating chamber lb by using rubber cushions 7 and 8.

The fan motor comprises a fan 9 and a motor 10. The motor 10 comprises a rotor 13, formed by securing a permanent magnet 12 to the rotational shaft 11, a stator 14 disposed around the rotor 13, a housing 15 covering the stator 14 and the rotor 13, and an end bracket 16. The stator 14 comprises a stator core 14*a* and a wire 14*b* to be wound. The fan 9 comprises a centrifugal blade 17 secured to the rotational shaft 11, a fixed guide blade 18 positioned between the centrifugal blade 17 and the motor 10, and a fan casing 19 for covering the fixed guide blade 18 and the centrifugal blade 17. The fan casing 19 is secured around the end bracket 16 by press-fitting.

A fine-dust catching filter 20, serving as means for preventing sticking of magnetic material, is fastened to the communicating port 1*d* in the partition body 1*c*. The fine-dust catching filter 20 is made of a filter material or a filter material which has been processed, the filter material being capable of absorbing and catching fine dust composed of magnetic materials such as iron dust. Furthermore, the fine-dust catching filter 20 is arranged in structure so that a proper ventilation resistance level is obtained.

Figure 2:
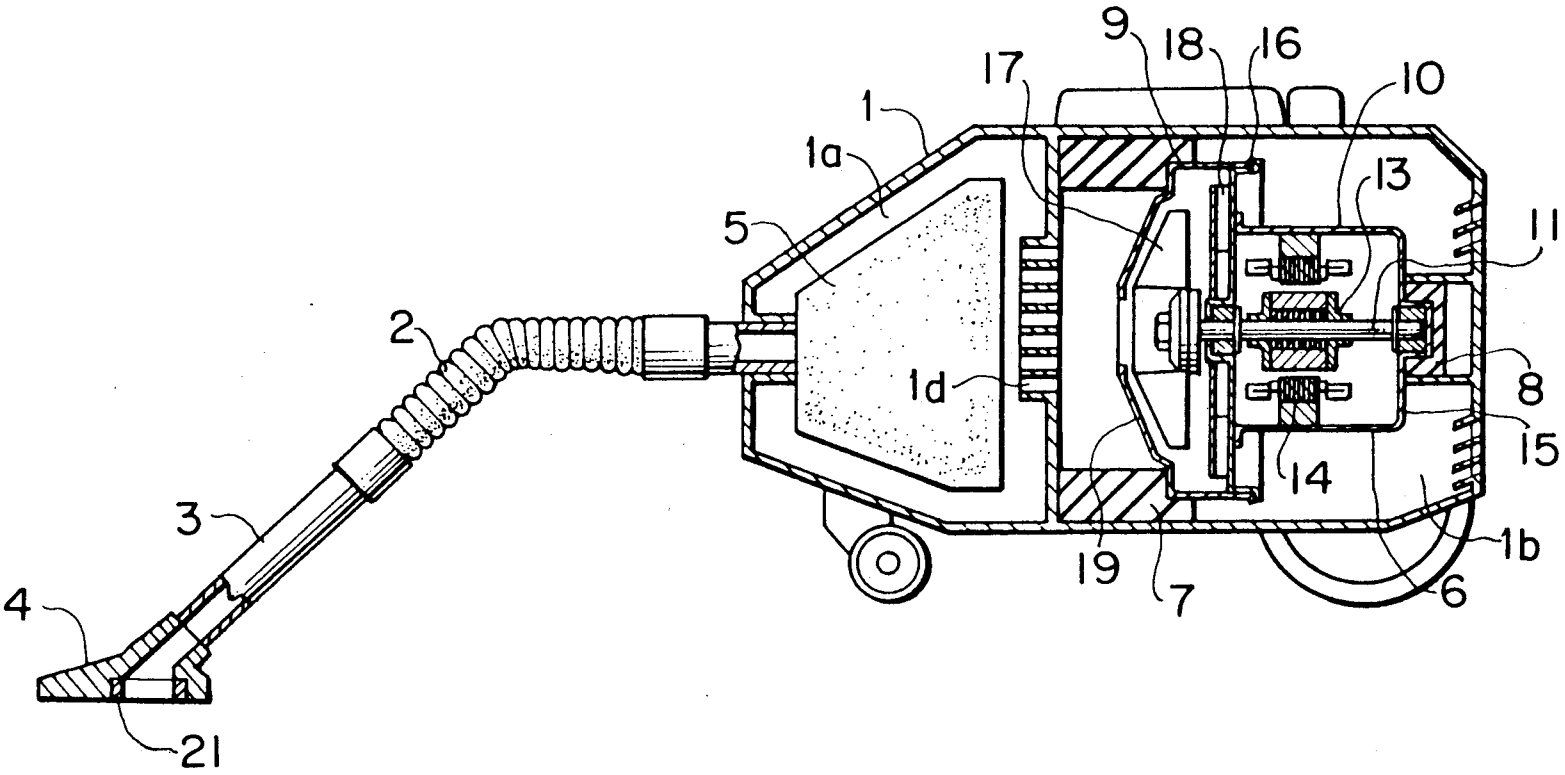
FIG. 2 is a vertical cross sectional view which illustrates a second embodiment of the present invention.
Figure 3:
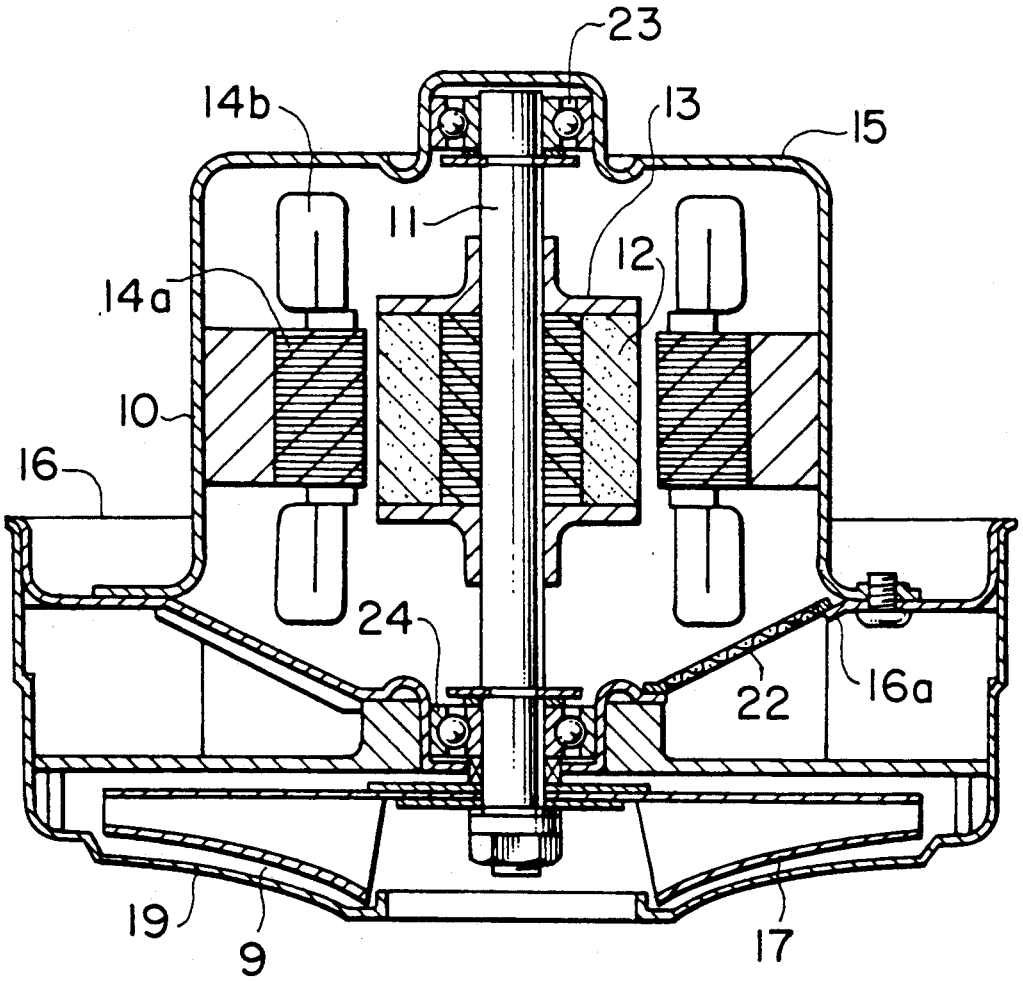
FIG. 3 is a vertical cross sectional view which illustrates an essential portion of a third embodiment of the present invention.
Figure 4:
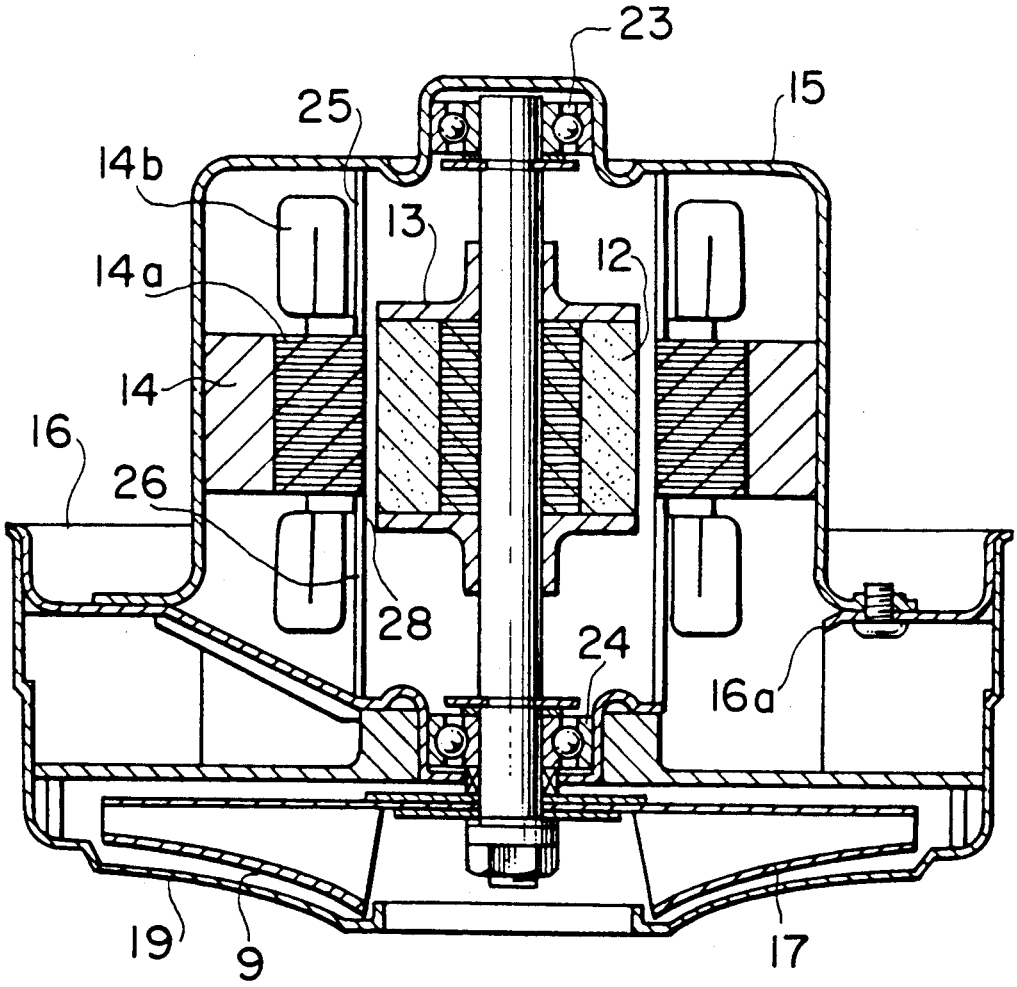
FIG. 4 is a vertical cross sectional view which illustrates an essential portion of a fourth embodiment of the present invention.
Figure 5:
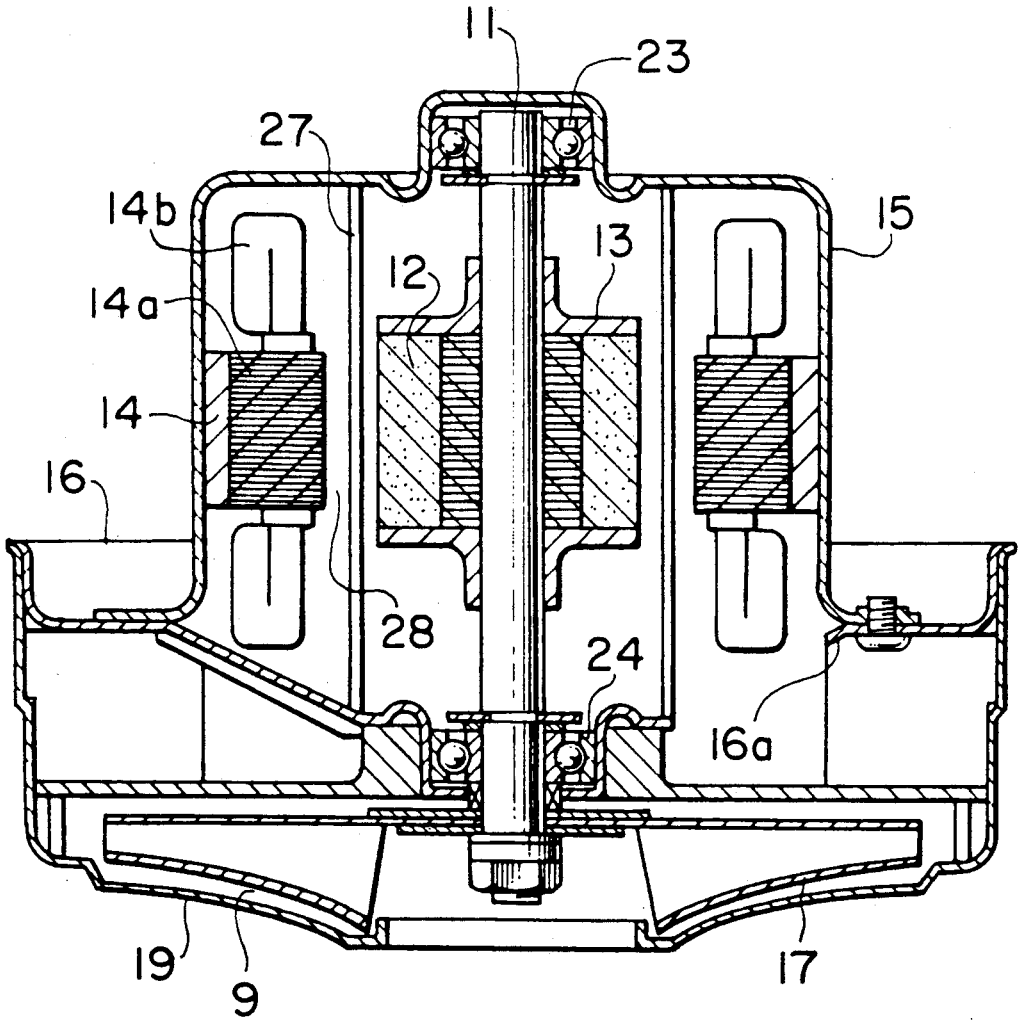
FIG. 5 is a vertical cross sectional view which illustrates an essential portion of a fifth embodiment of the present invention.

According to the second embodiment shown in FIG. 2, an absorbing body 21 is placed in a nozzle 14 for the purpose of preventing the sticking of the magnetic material to the rotor 13 of the motor 10. The absorbing body 21 is structured in such a manner that the magnetic material such as iron dust which is being suctioned by the nozzle 14 can be absorbed and caught. The absorbing body 21 may be formed by a strong permanent magnet so as to catch thumb tacks or needles. According to the third embodiment shown in FIG. 3, a finedust catching filter 22, which serves as means for preventing sticking of magnetic material, is fastened to an air inlet port 16*a* formed in the end bracket 16 of the motor 10. The fine-dust catching filter 22 is formed by a mesh whose size is so arranged as to cause a proper ventilation resistance level to be generated. The rotational shaft 11 is carried by a bearing 23 provided for the housing 15 and a bearing 24 provided for the end bracket 16. The fine-dust catching filter 22 absorbs and catches fine dust composed of magnetic materials such as iron dust flowing from the fan 9 so that the rotor 13 is protected from sticking of the magnetic materials. According to the fourth embodiment shown in FIG. 4, two insulating walls 25 and 26 surrounding the rotor 13 are provided. Each of the two insulating walls 25 and 26 is in the form of a cylinder. The first insulating wall 25 is positioned in contact with the end bracket 16 and the end surface of the fixed core 14*a*. Thus, the rotor 13 is hermetically closed by the two insulating walls 25 and 26 so that introduction of an air flow from the fan 9 into the portion around the rotor 13 is prevented. Therefore, even if fine dust composed of magnetic materials such as iron dust reaches from the fan 9, the fine dust cannot adhere the surface of the rotor 13. The fine dust is exhausted through an exhaust port formed in the housing to the outside of the fan motor 6. Therefore, according to the fourth embodiment, fine dust composed of magnetic materials such as iron dust which has passed through the dustcollecting filter 5 cannot adhere to the outer surface of the rotor without the need of providing the fine dust filter 20 according to the first embodiment. According to the fifth embodiment shown in FIG. 5, an insulating wall 27 for insulating the rotor 13 from an air flow from the fan 9 is provided in such a manner that it passes through a space 28 disposed between the stator 14 and the rotor 13. The insulating wall 27 is, as a cylindrical body, held between the housing 15 and the end bracket 16. According t the above-described structure, the number of components can be reduced in comparison to the fourth embodiment.

Figure 6:
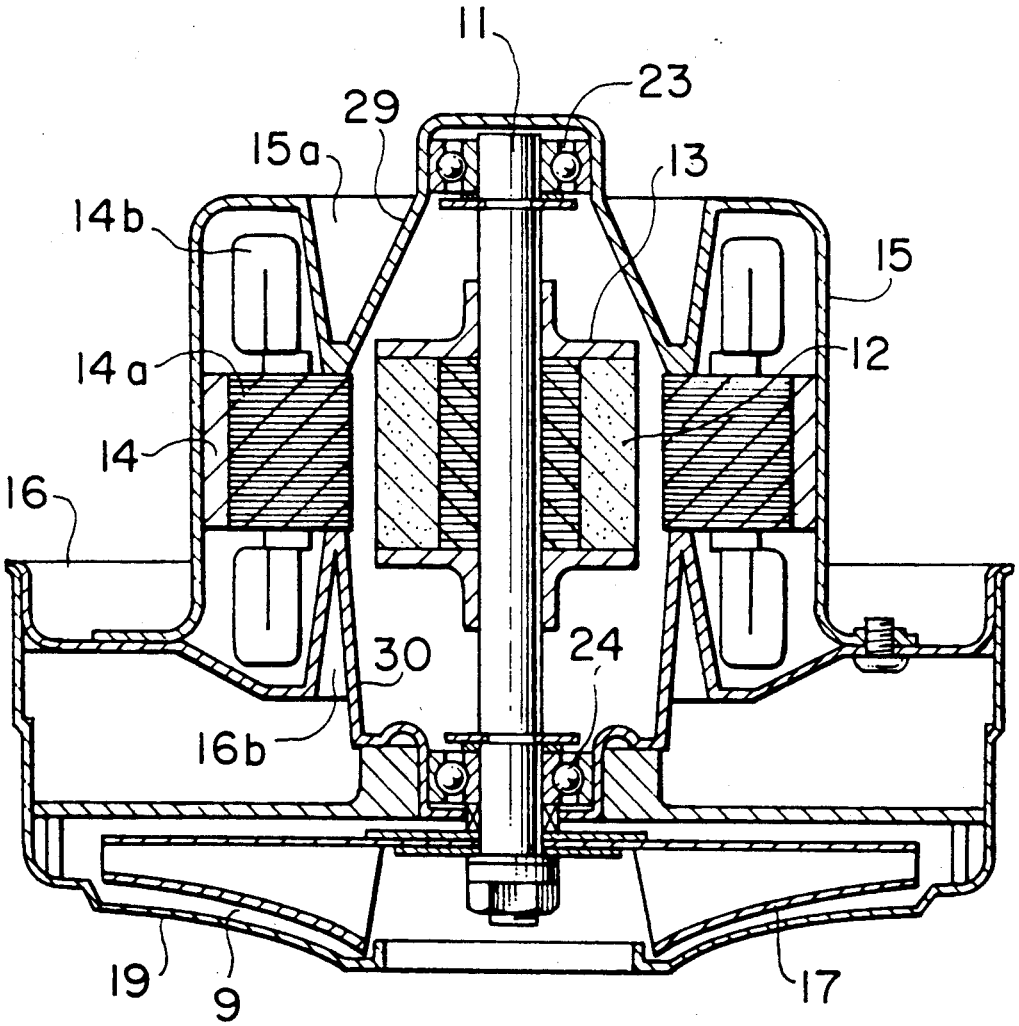
FIG. 6 is a vertical cross sectional view which illustrates an essential portion of a sixth embodiment of the present invention.

FIG. 6 illustrates a sixth embodiment of the present In the embodiment of FIG. 6, insulating walls 29 and 30 for insulating the rotor 13 from an air flow from the fan 9 are formed integrally with the housing 15 or the end bracket 16. That is, an annular reduction portion 15*a* is formed in the housing 15 so that the insulating wall 29 is created. The front end portion of the insulating wall 29 is positioned in contact with the stator core 14*a*. An annular reduction portion 16*b* is formed in the end bracket 16 s that the insulating wall 30 is created. The front end portion of the insulating wall 30 is positioned in contact with the stator core 14*a*. According to the above-described construction, the number of components can be reduced in comparison to the fourth and the fifth embodiments. Furthermore, according to the construction employed in the sixth embodiment, the rotor 13 can be reliably and hermetically closed by the housing 15 and the end bracket 16. The stator 14 can be supplied with cooling air by forming an opening, which is connected to only the stator 14, in the end bracket 16 and in the housing 15. According to each of the constructions employed in the fifth and the sixth embodiments, the rotor 13 can be perfectly insulated from an air flow from the fan 9 by the insulating wall 27 or the insulating walls 29 and 30. Therefore, even if fine dust composed of magnetic materials such as iron dust is flowed from the fan 9, the fine dust cannot stick to the outer surface of the rotor 13.

Each of the above-described embodiments is structured in such a manner that the fine-dust collecting filters 20 and 22, the absorbing body 21 and the insulating walls 25, 26, 27, 29 and 30 are independently provided. The present invention is not limited to the description above. A construction may be employed in which the above-described components are properly combined with one another. In this case, the fine dust composed of magnetic materials such as iron dust cannot stick to the space disposed between the rotor 13 and the stator 14. Furthermore, the ventilation resistance can be easily controlled to an extent with which the cleaning performance cannot be deteriorated.

According to the present invention, fine dust composed of magnetic materials such as iron dust and included in an air flow generated by the rotation of the fan motor is caught by the fine dust catching filter. Alternatively, even if the fine dust is introduced into the fan motor, the magnet portion in the rotor or the like is insulated from the air flow by the insulating wall. As a result, the adhesion of the fine dust between the rotor and the stator causing the rotor and the stator to be stuck can be prevented. Consequently, a vacuum cleaner having a fan motor which exhibits a long life and a satisfactory reliability can be provided.

Although the invention has been described in its preferred form with a certain degree of particularly, it is understood that the present disclosure of the preferred from has been changed in the details of construction and the combination and arrangement of parts may be resorted to without departing from the spirit and the scope of the invention as hereinafter claimed.

What is claimed is:

1. A vacuum cleaner comprising:

a fan disposed in a main body case of the vacuum cleaner;

a fan motor for driving said fan and including a rotor or stator of a permanent magnet;

a dust-collecting chamber for collecting dust suctioned into said main body case due to rotation of said fan motor;

a dust-collecting filter for causing said dust suctioned into said main body case to be caught in said dust-collecting chamber; and magnetic material adhesion preventing means disposed in an inlet passage of said fan motor, said magnetic material adhesion preventing means acting to prevent adhesion of fine dust composed of magnetic materials included in air flow to a vicinity of said permanent magnet.

2. A vacuum cleaner according to claim 1, wherein said magnetic material adhesion preventing means includes a fine-dust catching filter capable of catching said fine dust composed of said magnetic materials passing through said dust-collecting filter.

3. A vacuum cleaner according to claim 2, wherein said magnetic material adhesion preventing means is positioned between said dust-collecting filter and said fan motor.

4. A vacuum cleaner comprising:

a fan motor disposed in a main body case thereof and having a motor arranged in such a manner that its rotor or its stator uses a permanent magnet and a fan arranged to be rotated by said motor;

a dust-collecting chamber for collecting dust suctioned into said main body case due to rotation of said fan motor; and a dust-collecting filter for causing said dust suctioned into said main body case to be caught in said dust collecting chamber, wherein magnetic material adhesion preventing means is positioned between said fan and said motor, said magnetic material adhesion preventing means includes a fine-dust catching filter capable of catching said fine dust composed of magnetic materials passing through said dust-collecting filter, said magnetic material adhesion preventing means acting to prevent adhesion of fine dust composed of magnetic materials includes in said air flow to a portion in a vicinity of said permanent magnet.

5. A vacuum cleaner according to claim 1, wherein said magnetic material adhesion preventing means includes a body disposed in a nozzle communicated with said main body case and capable of catching suctioned dust composed of said magnetic materials.

6. A vacuum cleaner comprising:

a fan disposed in a main body case of the vacuum cleaner; a fan motor for driving the fan and including a rotor of a permanent magnet;

a dust-collecting chamber disposed in a suction side of said fan motor and capable of collecting dust suctioned into said main body case due to a rotation of said fan motor;

a dust-collecting filter for causing said dust suctioned into said main body case to be caught in said dust collecting chamber; and magnetic material adhesion preventing means provided in an inlet passage through which air flows due to a rotation of said fan motor, said magnetic material adhesion preventing means acting to prevent adhesion of fine dust composed of magnetic materials included in said air flow to a vicinity of said permanent magnet.

7. A vacuum cleaner comprising:

a fan motor disposed in a main body case thereof and consisting of a motor arranged in such a manner that its rotor uses a permanent magnet and a fan arranged to be rotated by said motor;

a dust-collecting chamber disposed in a suction side of said fan motor and capable of collecting dust suctioned into said main body case due to a rotation of said fan motor;

a dust-collecting filter for causing said dust suctioned into said main body case to be caught in said dust collecting chamber; and magnetic material adhesion preventing means including an insulating wall for hermetically insulating said rotor from air flow generated due to rotation of said fan motor provided in an inlet passage through which the air flows due to the rotation of the fan motor, said magnetic material adhesion preventing means acting to prevent adhesion of fine dust composed of magnetic materials included in said air flow to a vicinity of said permanent magnet.

8. A vacuum cleaner according to claim 7, wherein said insulating wall is formed by two cylindrical bodies, one of said two cylindrical bodies is disposed between a housing of said fan motor and a stator, and the other of said two cylindrical bodies is disposed between an end bracket of said fan motor and said stator.

9. A vacuum cleaner according to claim 8, wherein said cylindrical body disposed between said housing of said motor and said stator is formed integrally with said housing and said cylindrical body disposed between said end bracket of said motor and said stator is formed integrally with said end bracket.

10. A vacuum cleaner according to claim 6, wherein said magnetic material adhesion preventing means is a fine-dust catching filter in the form of a cylinder covering said rotor of said motor and is capable of catching said fine dust composed of magnetic materials.

11. A vacuum cleaner comprising:

a fan disposed in a main body case of the vacuum cleaner;

a fan motor including a rotor of a permanent magnet for rotatably driving said fan;

a dust-collecting chamber disposed in a suction side of said fan motor and capable of collecting dust suctioned into said main body case due to a rotation of said fan motor;

a dust-collecting filter for causing said dust suctioned into said main body case to be caught in said dust-collecting chamber; and magnetic material adhesion preventing means provided in an inlet passage through which air flows due to the rotation of said fan motor for preventing adhesion of fine dust composed of magnetic materials included in said air flow to a vicinity of said permanent magnet, said magnetic material adhesion preventing means comprising a fine-dust catching filter capable of catching fine dust composed of magnetic material passing through said dust-collecting filter and an insulating wall capable of insulating said rotor from an air flow generated due to the rotation of said fan motor.

12. A vacuum cleaner comprising:

a fan disposed in a main body case of the vacuum cleaner;

a fan motor for driving said fan and including a rotor or stator of a permanent magnet;

a dust-collecting chamber disposed in a suction side of said fan motor and capable of collecting dust suctioned into said main body case due to a rotation of said fan motor;

a dust-collecting filter for causing said dust suctioned into said main body case to be caught in said dust-collecting chamber; and magnetic material adhesion preventing means provided in an inlet passage through which air flows due to the rotation of said fan motor and for preventing adhesion of fine dust composed of magnetic materials included in said air flow to a vicinity of said permanent magnet, and wherein said dust-collecting filter serves as said magnetic adhesion preventing means by arranging the same so as to enable a catching of said fine dust composed of said magnetic materials.

* * * * *